United States Patent [19]

Chu et al.

[11] Patent Number: 4,467,023

[45] Date of Patent: Aug. 21, 1984

[54] LAYERED PHOTORESPONSIVE DEVICE CONTAINING HOLE INJECTING GROUND ELECTRODE

[75] Inventors: Joseph Y. C. Chu; Donald C. Von Hoene, both of Fairport, N.Y.

[73] Assignee: Xerox Corporation, Stamford, Conn.

[21] Appl. No.: 523,311

[22] Filed: Aug. 15, 1983

[51] Int. Cl.[3] ..... G03G 5/14

[52] U.S. Cl. ..... 430/66; 430/62; 430/59

[58] Field of Search ..... 430/57, 58, 66

[56] References Cited

U.S. PATENT DOCUMENTS

| | | | |
|---|---|---|---|
| 3,639,121 | 2/1972 | York | 430/62 |
| 3,684,503 | 8/1972 | Humphriss et al. | 430/66 |
| 4,015,985 | 4/1977 | Jones | 430/63 |
| 4,081,274 | 3/1978 | Hargan | 430/59 |
| 4,133,684 | 1/1979 | Tarumi et al. | 430/62 |
| 4,251,612 | 2/1981 | Chu et al. | 430/59 |

*Primary Examiner*—John D. Welsh
*Attorney, Agent, or Firm*—E. O. Palazzo

[57] ABSTRACT

An improved layered photoresponsive imaging device consisting of (1) a supporting substrate, (2) a photogenerating layer comprised of a charge carrier photogenerating pigment dispersed in a resinous binder, (3) a hole carrier transport layer, comprised of molecules of the formula dispersed in a highly insulating and transparent organic resinous material, wherein an X is selected from the group consisting of (ortho) $CH_3$, (meta) $CH_3$, (para) $CH_3$, (ortho) Cl, (meta) Cl, (para) Cl, and a hole injecting electrode strip comprised of carbon black particles and graphite particles dispersed in a resinous binder, which strip is attached to and extends the length of the non-image areas of the hole carrier transport layer.

16 Claims, 1 Drawing Figure

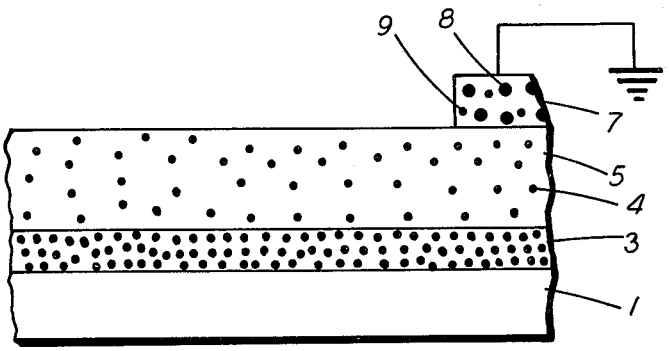
9
8
7
5
4
3
1

LAYERED PHOTORESPONSIVE DEVICE CONTAINING HOLE INJECTING GROUND ELECTRODE

BACKGROUND OF THE INVENTION

This invention is generally directed to photoresponsive imaging devices, and more specifically the present invention is directed to improved layered photoresponsive or photoconductive imaging devices containing a substrate, a photogenerating layer, a charge transport layer, and a ground strip hole injecting electrode in contact with a portion of the hole transport layer. In one embodiment of the present invention, a strip of the hole injecting electrode which is attached to the non-image areas of the hole transport layer is comprised of a mixture of conductive particles, such as carbon black, dispersed in a resinous binder material. The improved photoresponsive devices of the present invention are useful as imaging members in electrostatographic imaging systems, particularly xerographic imaging systems, wherein latent images are formed thereon, and made visible by developer compositions containing toner particles and carrier particles. When used in such systems, the improved photoresponsive devices of the present invention are generally charged negatively.

Electrostatographic imaging systems, which are well known involve the formation and development of electrostatic latent images on the surface of photoconductive materials referred to in the art as photoreceptors or photosensitive compositions. In these imaging systems, and in particular in xerography, the xerographic plate containing the photoconductive insulating layer is imaged by uniformly electrostatically charging its surface, followed by exposing the layer to a pattern of activating electromagnetic radiation such as light, which selectively dissipates the charge in the illuminated areas of the photoconductive member causing a latent electrostatic image to be formed in the non-illuminated areas. This latent electrostatic image can then be rendered visible with developer compositions containing toner particles and carrier particles. Many known photoconductive members can be selected for incorporation into the electrostatic imaging system including, for example, photoconductive insulating materials deposited on conductive substrates, as well as those containing a thin barrier layer film of aluminum oxide situated between the substrate and the photoconductive composition, primarily for the purpose of preventing charge injection from the substrate into the photoconductive layer upon charging of its surface, as charge injection could adversely affect the electrical properties of the photoreceptor, and thus the quality of the resulting images.

Examples of photoconductive members include materials comprised of inorganic materials and organic materials, layered devices comprised of inorganic or organic materials, composite layered devices containing photoconductive substances dispersed in other materials, and the like. An example of an early type of composite photoconductive layer used in xerography is described, for example, in U.S. Pat. No. 3,121,006 wherein there is disclosed a number of layers comprising finely divided particles of a photoconductive inorganic compound dispersed in an electrically insulating organic resinous binder. Examples of specific binders disclosed in this patent include, for example, polystyrene resins, silicone resins, acrylic and methacrylic ester polymers, polymerized derivatives of acrylic and alpha acrylic acids, chlorinated rubbers, vinyl polymers, and co-polymers, and cellulose esters.

Illustrative examples of other known photoconductive compositions include amorphous selenium, halogen doped amorphous selenium substances, amorphous selenium alloys, including selenium arsenic, selenium tellurium, selenium arsenic antomony, halogen doped selenium alloys, wherein the halogen is a material such as chlorine, fluorine, or bromine, such halogen generally being present in amounts of 50 parts per million to about 1,000 parts per million, cadmium sulfide, and the like. Generally, these photoconductive materials are deposited on suitable conductive substrates, and incorporated into the xerographic imaging system for use as the imaging member.

Recently, there has been disclosed negatively charged layered photoresponsive devices comprised of photogenerating layers and transport layers deposited on conductive substrates, reference, for example, U.S. Pat. No. 4,265,990, and overcoated photoresponsive materials containing a hole injecting layer, overcoated with a hole transport layer, followed by an overcoating of a photogenerating layer, and a top coating of an insulating organic resin, as described, for example, in U.S. Pat. No. 4,251,612. Examples of photogenerating layers disclosed in these patents include trigonal selenium and various phthalocyanines; and as transport layers, there is described the use of certain diamines dispersed in inactive polycarbonate resinous binders. The disclosures of each of these patents, namely, U.S. Pat. Nos. 4,265,990, and 4,251,612 are totally incorporated herein by reference.

Additionally, there is disclosed in U.S. Pat. No. 3,639,121 an electrophotographic imaging element which is externally grounded during charging, and is comprised of a support layer, an electrically conductive layer overlaying the support, a photoconductive layer overlaying the conductive layer, and a layer of conducting lacquer distinct from the conductive layer coated on the edge of the element so as to electrically connect the conducting layer to external ground during charging of the element, the lacquer in one embodiment comprising a dispersion of conductive material, such as carbon black, or graphite, in a resinous binder polymeric binder, reference, for example, the disclosure in Col. 2, beginning at around line 26.

While the above-described photoresponsive devices are suitable for their intended purposes, there continues to be a need for improved devices. Additionally, there is a need for improved photoresponsive devices containing a hole injecting grounding electrode, which is not in contact with the conductive supporting substrate, allowing for the production of photoresponsive devices having consistent reliable properties with extended usage. Additionally, there continues to be a need for improved photoresponsive devices wherein precision coating processes are not needed for applying the grounding strip, and furthermore, the improved photoresponsive devices of the present invention can be prepared by simultaneously coating the grounding strip and charge transport layer.

SUMMARY OF THE INVENTION

It is an object of the present invention to provide an improved photoresponsive device, and a method of imaging utilizing this device.

It is another object of the present invention to provide an improved photoresponsive imaging device containing a ground strip hole injecting electrode.

It is yet another object of the present invention to provide an improved photoresponsive imaging device comprised of a conductive substrate, a photogenerating layer, a hole transport layer, and in contact with the non-image areas of the hole transport layer, a hole injecting electrode which functions as a ground electrode.

In a further object of the present invention, there is provided a ground strip for an improved photoresponsive imaging device, which strip contains carbon black, or graphite, particles dispersed in a resinous binder.

In a further object of the present invention, there is provided an improved photoresponsive device which can be economically prepared, and wherein the conductive ground strip and transport layer of the device can be simultaneously coated.

In yet a further object of the present invention, there is provided an improved photoresponsive imaging device which is charged negatively prior to image-wise exposure.

These and other objects of the present invention are accomplished by providing an improved layered photoresponsive imaging device comprised of a supporting substrate, a photogenerating layer, a hole transport layer, and a strip of a hole injecting ground electrode. More specifically, the present invention in one embodiment is directed to an improved layered photoresponsive imaging device comprised in the order stated of (1) a conductive supporting substrate, (2) a photogenerating layer, (3) a charge carrier hole transport layer, and (4) a ground strip hole injecting electrode attached to the non-image areas of the hole transport layer and comprised of carbon black or graphite particles dispersed in a resinous binder composition. These can also be included in the improved photoresponsive device of the present invention an optional adhesive interface layer, situated between the supporting conductive substrate and the photogenerating layer.

Also included within the scope of the present invention are methods of imaging wherein the improved photoresponsive imaging device disclosed herein subsequent to being negatively charged is subjected to an imaging process for the purpose of forming an electrostatic latent image thereon, followed by developing this image with a developer composition comprised of toner particles and carrier particles, subsequently transferring the developed image to a suitable substrate, and optionally permanently affixing the image thereto by heat, and/or pressure.

BRIEF DESCRIPTION OF THE DRAWINGS

For a better understanding of the present invention, and further features thereof, reference is made to the following detailed description of various preferred embodiments wherein:

The FIGURE is a partially schematic cross-sectional view of the photoresponsive imaging device of the present invention.

DESCRIPTION OF THE PREFERRED EMBODIMENTS

Illustrated in the FIGURE is a layered photoresponsive imaging device of the present invention comprising a supporting substrate 1 an optional adhesive layer, not shown, a photogenerating layer 3, containing a photogenerating pigment dispersed in a resinous binder 2, a layer of charge carrier hole transport material 5, containing a charge transporting substance dispersed in a resinous binder 4, and a ground strip hole injecting electrode 7, containing carbon black, or graphite particles 8, dispersed in a resinous binder 9.

The supporting substrate 1 may be comprised of numerous suitable materials possessing, for example, suitable mechanical properties enabling support of the remaining layers. Generally, this layer is comprised of an organic polymeric substance containing on its surface a metal, such as aluminum, nickel, chromium, brass, or the like. Illustrative examples of organic polymeric substances include polyesters, polyurethanes, polyamides, and the like, with polyesters being preferred. One preferred substrate selected for the photoresponsive device of the present invention is commercially available as aluminized Mylar. The substrate may be flexible or rigid, and can have a number of many different configurations including, for example, a plate, a cylindrical drum, a scroll, an endless flexible belt, and the like. Preferably, the substrate is in the form of an endless flexible belt, and it is comprised of aluminized Mylar.

The thickness of substrate 1 depends on a number of variables including, for example, economical considerations, and the thicknesses of the other layers. Generally, the substrate may be of substantial thickness, for example, over 200 microns, or of minimum thickness, less than 50 microns, providing the objectives of the present invention are achieved. In one embodiment of the present invention, the thickness of the substrate 1 is from about 65 microns to about 150 microns, and preferably is of a thickness of from about 75 microns to about 125 microns.

The photogenerating layer 3 in contact with the conductive layer 1 is comprised of inorganic or organic photoconductive materials, or pigments, dispersed in an inactive resinous binder 2. Illustrative examples of inorganic photoconductive materials include those well known in the art, reference U.S. Pat. No. 4,251,612, the disclosure of which is totally incorporated herein by reference, such as amorphous selenium, selenium alloys, including selenium tellurium, selenium tellurium arsenic, selenium arsenic, cadmium sulfoselenide, cadmium selenide, cadmium sulfide, and other forms of selenium and selenium alloys, including the crystalline form of selenium known commonly as trigonal selenium. Additionally, there can be selected as the photogenerating substances selenium materials, and selenium alloys, having added thereto various known dopants including halogens and alkali metals. Examples of specific dopants that may be used are chlorine, bromine, iodine, and sodium, which dopants are present in an amount of from about 50 parts per million to about 5,000 parts per million, and preferably from about 100 to about 300 parts per million. In addition to trigonal selenium, one preferred inorganic photoconductive material useful for the photogenerating layer is a halogen doped selenium arsenic alloy, wherein the percentage by weight of selenium is from about 95 to about 99.95 percent, the percentage of arsenic is from about 5 percent to about 0.5 percent, and the halogen chlorine is present in an amount of from about 100 parts per million to about 200 parts per million.

Illustrative examples of organic photoconductive materials selected as the photogenerating pigment for layer 3 include various known materials such as metal-free phthalocyanines, metal phthalocyanines, vanadyl phthalocyanines, which are preferred, intermolecular charge transfer complexes including poly(n-vinylcarbazole) and trinitrofluorenone, and the like, as well as the additional organic photogenerating pigments disclosed in U.S. Pat. Nos. 4,265,990, and 4,251,612, the disclosure of each of these patents being totally incorporated herein by reference. Other specific examples of photogenerating pigments include the X-form of metal-free phthalocyanines, reference U.S. Pat. No. 3,357,989, the disclosure of which is totally incorporated herein by reference, metal phthalocynines, such as copper phthalocynines, quinacridones commercially available from DuPont Chemical Corporation under the trade names Monastral Red, Monastral Violet, and Monastral Red Y, substituted 2,4-diaminotriazines, reference U.S. Pat. No. 3,442,781, and polynuclear aromatic quinones available from Allied Chemical Corporation. Also useful as a photogenerating pigment are various known squarilium substances.

Illustrative examples of polymeric resinous binder materials 2 that can be selected include those as described, for example, in U.S. Pat. No. 3,121,006, polyesters, polyvinylbutyral, polycarbonate resins, polyvinylcarbazole, epoxy resins, polystyrene, vinyl polymers, polyhydroxy resins, especially those commercially available as poly(hydroxy ether resins), and the like.

The photogenerating pigment for layer 3 can comprise 100 percent of the layer, or this material can be dispersed in the resinous binder 2 in amounts of from about 5 percent by volume to about 95 percent by volume, and preferably in amounts of from about 25 percent by volume to about 75 percent by volume.

The photogenerating layer can be of various appropriate thicknesses providing the objectives of the present invention result, generally, however, this layer ranges in thickness of from about 0.1 microns to about 5 microns, and preferably is of a thickness of from about 0.3 microns to about 1 micron. In one preferred embodiment of the present invention, the photogenerating layer is of a thickness of 0.5 microns.

The charge carrier hole transport layer 5 can be comprised of numerous suitable substances which are capable of transporting holes, this layer having a thickness of from about 5 microns to about 50 microns, and preferably is of a thickness of from about 15 microns to about 40 microns. The charge carrier transport material is dispersed in an inactive resinous binder 4. In a preferred embodiment, the charge transport layer comprises diamine molecules of the formula:

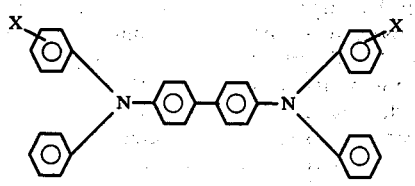

dispersed in an organic resinous binder material 4 wherein X is selected from the group consisting of (ortho) $CH_3$, (meta) $CH_3$, (para) $CH_3$, (ortho) Cl, (meta) Cl, or (para) Cl. This charge transport layer which is described in detail in U.S. Pat. Nos. 4,265,990, and 4,251,612 is substantially non-absorbing in the spectral region of intended use, i.e., visible light, but is "active" in that it allows injection of photogenerated holes from the charge generating layer.

Illustrative examples of diamines corresponding to the above formula include N,N',diphenyl,-N,N'-bis(alkylphenyl)-[1,1'-biphenyl]-4,4'-diamine wherein an alkyl is methyl, such as 2-methyl, 3-methyl, or 4-methyl, ethyl, propyl, butyl, and the like. With chloro substitution, the diamine is referred to as N,N'-diphenyl-N,N'bis(halophenyl)-[1,1'biphenyl]-4,4'-diamine wherein halo atom is 2-chloro, 3-chloro, or 4-chloro.

Other electrically active small molecules which can be dispersed in the resinous binder 4 to form a layer which will transport holes include triphenylmethane, bis(4-diethylamino-2-methylphenyl)phenylmethane, bis-4 (diethylaminophenyl)phenylmethane, 4,4'-bis(diethylamino-2,2'-dimethyl)triphenylmethane, and the like.

Numerous inactive resinous binder materials 4 can be selected for the charge transport layer including those described in U.S. Pat. No. 3,121,006, polycarbonates, acrylic polymers, vinyl polymers, cellulose polymers, polyesters, polyamides, polyurethanes, poly(hydroxy ethers), and the like. Preferred binder materials 4 include polycarbonate resins having a molecular weight of from about 20,000 to about 100,000, with a molecular weight in the range of from about 50,000 to about 100,000 being particularly preferred, and polyhydroxy ethers commercially available as Bakelite resin PKHH, and Araldite, hydroxy resin 6097.

The charge transport active molecules are dispersed in the resinous binder 4 in various effective amounts generally, however, from about 10 percent by weight to about 75 percent by weight of the charge transport substance, and preferably from about 40 percent by weight to about 50 percent by weight is dispersed in from about 25 percent by weight to about 90 percent by weight, and preferably from about 50 percent by weight to about 60 percent by weight of the resinous binder material.

The thickness of the charge transport layer depends on a number of factors including the thickness of the other layers, and the electrical activity desired for the photoresponsive device. Generally, the thickness of this layer as indicated herein is from about 5 microns to about 50 microns, however, thicknesses outside these ranges can be selected for the charge transport layer providing the objectives of the present invention are obtained.

The ground hole injecting electrode 7, which is of a thickness of from about 1 to about 20 microns or more, and preferably is of a thickness of from about 4 microns to about 10 microns is comprised of hole injecting conductive particles, 8, such as carbon black, or graphite, dispersed in a resinous binder in various amounts, for example, from about 1 percent to about 20 percent by weight. Thus, electrode 7 is comprised of materials which are capable of injecting charge carriers under the influence of an electrical field. Different numerous forms of carbon black and graphite are useful, including furnace carbon blacks, and channel carbon blacks, commercially available from many sources such as Cabot Corporation. Specific illustrative examples of these materials include the carbon blacks Vulcan XC-72R, Vulcan 6, Black Pearls L, and Monarch 1300, all commercially available from Cabot Corporation, and graphite commercially available from Superior Graphite Company. Other carbon blacks may be useful providing they do not substantially adversely affect the device, however, such materials should have sufficient conductivity, cause the injection of holes, and be capable of forming uniform dispersions in a polymeric resinous binder. Insofar as conductivity is concerned, these materials generally have a range of electrical resistivity values which depend on many factors such as the thickess of this layer. The range of electrical resistivity is generally less than about 20,000 ohms per square, when the thickness of this layer is from about 4 to about 7 microns. Electrical resistivity can be greater than 20,000 or substantially less providing that the properties of the imaging device are not adversely affected.

Illustrative examples of resinous binder polymers 9 within which the conductive particles are dispersed include, for example, polyesters such as PE-100 commercially available from Goodyear Chemical Company. Other polyester materials that are useful include those materials classified as polymeric esterfication products of a dicarboxylic acid and a diol comprising a diphenol. Typical diphenols include 2,2-bis(4-betahydroxyethoxyphenyl)propane, 2,2-bis(4-hydroxyisopropoxyphenyl)propane, 2,2-bis(4-betahydroxyethoxyphenyl)pentene, 2,2-bis(4-betahydroxyethoxyphenyl)butane, and the like, while typical dicarboxylic acids include oxalic, malonic, succinic, adipic acid, phthalic acid, terephthalic acid, maleic acid, fumaric acid, and the like. The primary purpose of the hole injecting ground strip electrode is to provide an electrical path to ground, by injecting holes, or positive charges into the transport layer. By ground is meant an arbitrary, value such as 0 volts, for example, and the phrase "+800 volts" refers to a charge of 800 volts above the ground potential.

As illustrated in the FIGURE, the hole injecting layer is in the form of a strip that is attached to, and extends the entire length of the hole transport layer. Usually, the hole injecting electrode is contained on the hole transport layer in the non-image areas only. In one embodiment of the present invention, this strip has a width of up to about 2 centimeters, however, widths greater than 2 centimeters can be selected.

The improved photoresponsive imaging devices of the present invention can be prepared by a number of known methods, the process parameters and order of the coating of the layers being dependent on the device desired. Thus, for example, the improved photoresponsive device of the present invention can be prepared by providing a conductive substrate layer, and applying thereto by solvent coating processes, laminating processes, or other known methods, a photogenerating layer, a hole transport layer, and the ground strip hole injecting electrode.

The hole injecting ground strip electrode which is comprised of conductive particles, such as graphite or carbon black dispersed in a resinous binder, is generally prepared by the solution casting of a mixture of carbon black or graphite. Other well-known film forming techniques can be used for preparing this electrode such as spraying or thermal film extrusion. It is believed that the dispersed carbon black or graphite functions as a hole injecting electrode, as well as a conductive medium, and that the polymer in addition to acting as a dispersement substantially permanently adheres the ground strip to the hole carrier transport layer.

The invention will now be described in detail with respect to specific preferred embodiments thereof, it being understood that these examples are intended to be illustrative only, and that the invention is not intended to be limited to the materials, conditions, process parameters, and the like, recited herein. All parts and percentages are by weight unless otherwise indicated.

EXAMPLE I

There was prepared the following hole injecting ground electrode solutions by ball-milling the mixtures indicated in methylene chloride in a utility jar mill (Norton) at room temperature for 22 hours.

A. 7.1 percent of Monarch 1300 carbon black, commercially available from Cabot Corporation, and 8.5 percent by weight, of a polyester commercially available from Goodyear Chemicals as PE-100.

B. 4.7 percent by weight of Monarch 1300 carbon black, and 6 percent by weight of a polycarbonate commercially available from Mobay Chemical Company, as Makrolon.

C. 5 percent by weight of Black Vulcan 6 carbon black, commercially available from Cabot Corporation, and 6 percent by weight of a polyester commercially available from Goodyear Chemicals as PE-200.

D. 5 percent by weight of graphite commercially available from Superior Graphite Company, and 6 percent by weight of a polyester commercially available from Goodyear Chemical Company as PE-100.

EXAMPLE II

A photoreceptor was prepared by providing an aluminized Mylar substrate in a thickness of 3 mils, and applying thereto in a wet thickness of 0.5 mils, a layer of 0.5 percent by weight of DuPont 49,000 polyester adhesive, in methylene chloride and 1,1,2-trichloroethane (4:1 of volume ratio) with a Bird applicator. The wet thickness was 0.5 mils. This layer was then allowed to dry for 1 minute at room temperature, and 10 minutes at 100 degrees centigrade in a forced air oven. The resulting layer had a dry thickness of about 0.05 microns.

A photogenerating layer containing 30 percent by volume of trigonal selenium, and 75 percent by volume of polyvinylcarbazole was then prepared as follows:

In a two-ounce bottle was added 0.8 grams of polyvinylcarbazole, and 18 milliliters, 1 to 1 volume ratio of tetrahydrofuran. There was then added to this solution 2.1 grams of trigonal selenium, and 100 grams of stainless steel shot, one-eighth of an inch in diameter. The above mixture was then placed on a ball mill for 72 to 96 hours. There results a slurry which was placed on a shaker for 10 minutes followed by coating this slurry on the above 49,000 adhesive layer with a Bird applicator to a wet thickness of 0.5 mills. The resulting device was then allowed to air dry 1 to 5 minutes resulting in a dry thickness for the photogenerating layer of 0.5 microns.

There was then coated with a Bird applicator to a 25 micron dry thickness on top of the above photogenerating layer a transport layer containing 50 percent by weight of Makrolon, a polycarbonate resin having a molecular weight of from about 50,000 to about 100,000, mixed with 50 percent by weight of N,N' diphenyl-N,N'-bis(3-methylphenyl)-[1,1'-biphenyl]-4,4-diamine.

There was then applied to the above-prepared hole transport layer, a narrow strip, about 1 centimeter in width, and for the entire length of this layer, the hole injecting ground electrode mixture A as prepared in Example I, this application being accomplished with a Bird applicator. The dry thickness of the hole injecting ground strip electrode was 4 microns.

The resulting photoreceptor was then charged to a −800 volts surface potential, followed by uniformly illuminating the photoreceptor with white light. Electrical measurements of this device with a voltmeter indicated that the field existing across the photoreceptor was discharged to a substantially zero potential. Accordingly, the hole injecting ground strip functioned as designed, and further, the responsive device would be useful for generating acceptable electrostatic latent images since it could be discharged to substantially zero volts.

EXAMPLE III

There were prepared three photoreceptors by repeating the procedure of Example II with the exception that the hole injecting ground electrode solutions were comprised of solutions B, C, and D as prepared in Example I. Substantially similar results were obtained when the resulting photoreceptor was charged to a −800 volts surface potential and then uniformly illuminated with white light. Accordingly, the photoresponsive devices of this example would be useful for generating acceptable electrostatic images in that electrical measurements with a voltmeter for each of the photoreceptors indicated that the field across the photoreceptor was discharged to substantially zero potential.

EXAMPLE IV

There was prepared a photoreceptor by providing an aluminized Mylar substrate, in a thickness of 5 mils. A charge carrier photogenerating composition was then prepared by placing 0.7 grams of vanadyl phthalocyanine, and 1.5 grams of a polyester resin commercially available from Goodyear Chemicals, as PE-100, in methylene chloride. This mixture was then subjected to ball milling for about 78 hours. An approximately 1 micron thick layer of the resulting composition was then deposited over the above aluminized substrate by solvent coating using a draw bar coating technique. The residual solvent was removed by oven drying and subsequently the dried film was then overcoated with an approximately 25 micron thick amine hole transport layer by repeating the procedure of Example II.

Subsequently, there was applied to the hole transport layer a hole injecting ground strip electrode containing carbon black dispersed in a polyester, by repeating the process of Example II. The resulting photoreceptor was then charged to −800 volts surface potential, and subsequently uniformly illuminated with white light. Electrical measurement of this device with a voltmeter indicated that the field across the photoreceptor was discharged to substantially zero potential. Charging to −800 volts surface potential and subsequently uniformly illuminating with white light was repeated 1,000 times, and substantially similar results were obtained, that is, electrical measurement with a voltmeter indicated that the field across the photoreceptor was discharged to substantially zero potential. Accordingly, electrostatic latent images can be generated with the photoreceptor prepared in this Example, as indicated by discharge of the photoreceptor to substantially zero potential.

EXAMPLE V

There were prepared two photoconductive devices, by repeating the procedure of Example IV, with the exception that the photogenerating pigment, in place of the vanadyl phthalocyanine, there was selected alpha metal-free phthalocyanine, and the X-form of metal-free phthalocyanine, respectively. When these photoreceptors were charged to −800 volts surface potential and subsequently uniformly illuminated with white light by repeating the procedure of Example IV, there resulted substantially similar results, that is, electrical measurements with a voltmeter indicated that the field across the photoreceptors was discharged to substantially zero potential.

Although the invention has been described with reference to specific preferred embodiments, it is not intended to be limited thereto. Rather, those skilled in the art will recognize that variations and modifications may be made therein which are within the spirit of the invention and within the scope of the following claims.

We claim:

1. An improved layered photoresponsive imaging device consisting of
   (1) a supporting substrate,
   (2) a photogenerating layer comprised of a charge carrier photogenerating pigment dispersed in a resinous binder,
   (3) a hole carrier transport layer, comprised of molecules of the formula:

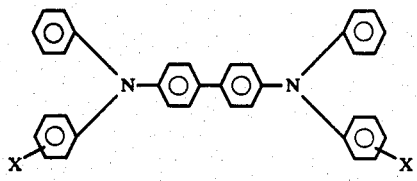

dispersed in a highly insulating and transparent organic resinous material, wherein an X is selected from the group consisting of (ortho) $CH_3$, (meta) $CH_3$, (para) $CH_3$, (ortho) Cl, (meta) Cl, (para) Cl, and a hole injecting electrode strip comprised of carbon black particles and graphite particles dispersed in a resinous binder, which strip is attached to and extends the length of the non-image areas of the hole carrier transport layer.

2. An improved photoresponsive device in accordance with claim 1 wherein the conducting supporting substrate is of a thickness of from about 50 microns to about 250 microns, and is comprised of an aluminized polymeric composition.

3. An improved photoresponsive device in accordance with claim 1 wherein the charge carrier photogenerating layer is of a thickness of from about 0.1 microns to about 5 microns, and is comprised of selenium, alloys of selenium, metal phthalocyanines, metal-free phthalocyanines, or vanadyl phthalocyanines.

4. An improved photoresponsive device in accordance with claim 3, wherein the charge carrier photogenerating composition is trigonal selenium.

5. An improved photoresponsive device in accordance with claim 3 wherein the charge carrier photogenerating composition is vanadyl phthalocyanine.

6. An improved photoresponsive device in accordance with claim 1 wherein the resinous binder for the charge carrier photogenerating composition is comprised of polyesters, polycarbonates, vinyl polymers, or acrylate polymers.

7. An improved photoresponsive device in accordance with claim 6 wherein the charge carrier photogenerating pigment is present in an amount of from about 25 percent by volume to about 75 percent by volume, and the resinous binder is present in an amount of from about 75 percent by volume to about 25 percent by volume.

8. An improved photoresponsive device in accordance with claim 1 wherein the thickness of the charge carrier transport layer ranges from about 5 microns to about 50 microns.

9. An improved photoresponsive device in accordance with claim 1 wherein the charge carrier transport molecule is dispersed in a resinous binder in an amount of from about 10 percent by weight to about 75 percent by weight.

10. An improved photoresponsive device in accordance with claim 1 wherein the charge transport composition is comprised of N,N' diphenyl N,N'-bis(3-methylphenyl)-[1,1'-biphenyl]-4,4' diamine.

11. An improved photoresponsive device in accordance with claim 1 wherein the resinous binder for the hole carrier transport layer is a polycarbonate having a molecular weight of from about 20,000 to about 100,000 or a polyhydroxy ether.

12. An improved photoresponsive device in accordance with claim 10 wherein the charge carrier transport composition is present in the resinous binder in an amount of from about 10 percent by weight to about 25 percent by weight.

13. An improved photoresponsive device in accordance with claim 10 wherein the thickness of the charge transport layer is from about 5 microns to about 50 microns.

14. An improved photoresponsive device in accordance with claim 1 wherein the resinous binder for the ground strip electrode is a polyester.

15. An improved photoresponsive device in accordance with claim 14 wherein the carbon black or graphite is present in the resinous binder in an amount of from about 1 percent by weight to about 20 percent by weight.

16. An improved imaging device in accordance with claim 1 wherein the thickness of the ground strip layer is from about 1 micron to about 20 microns.

* * * * *